US005298944A

United States Patent [19]

Sawayama et al.

[11] Patent Number: 5,298,944

[45] Date of Patent: Mar. 29, 1994

[54] TESTING IMAGE DENSITY TO CONTROL TONER CONCENTRATION AND DYNAMIC RANGE IN A DIGITAL COPIER

[75] Inventors: Noboru Sawayama; Takayuki Maruta; Mitsuo Hasebe, all of Tokyo, Japan

[73] Assignee: Ricoh Company, Ltd., Tokyo, Japan

[21] Appl. No.: 92,940

[22] Filed: Jul. 19, 1993

Related U.S. Application Data

[63] Continuation of Ser. No. 827,868, Jan. 30, 1992, abandoned, which is a continuation of Ser. No. 545,508, Jun. 29, 1990, abandoned.

[30] Foreign Application Priority Data

Jun. 30, 1989 [JP] Japan ..... 1-168760

[51] Int. Cl.[5] ..... G03G 21/00

[52] U.S. Cl. ..... 355/208; 118/689; 355/203; 355/214; 355/246

[58] Field of Search ..... 355/203, 204, 205, 206, 355/207, 208, 209, 214, 246, 326, 327; 222/DIG. 1; 118/689, 691

[56] References Cited

U.S. PATENT DOCUMENTS

| | | | |
|---|---|---|---|
| 4,248,527 | 2/1981 | Akiyama et al. | 355/246 |
| 4,277,162 | 7/1981 | Kasahara et al. | 355/208 |
| 4,313,671 | 2/1982 | Kuru | 355/246 X |
| 4,348,099 | 9/1982 | Fantozzi | 355/208 |
| 4,350,435 | 9/1982 | Fisk et al. | 355/208 |
| 4,466,731 | 8/1984 | Champion et al. | 355/246 |
| 4,572,654 | 2/1986 | Murai et al. | 355/246 X |
| 4,647,184 | 3/1987 | Russell et al. | 355/208 |
| 4,786,924 | 11/1988 | Folkins | 355/208 |
| 4,816,863 | 3/1989 | Lee | 355/208 |
| 4,888,636 | 12/1989 | Abe | 355/326 X |
| 4,962,407 | 10/1990 | Ueda | 355/208 |
| 4,999,673 | 3/1991 | Bares | 355/208 |

*Primary Examiner*—Benjamin R. Fuller
*Assistant Examiner*—John E. Barlow, Jr.
*Attorney, Agent, or Firm*—Oblon, Spivak, McClelland, Maier & Neustadt

[57] ABSTRACT

A developing system of the type using a two-component developer and capable of reproducing image densities and halftone images stably with no regard to changes in ambient conditions and aging. At least two toner image patterns each having a different toner density are formed on a photoconductive element. The amounts of toner deposited on the individual patterns are sensed by a photosensor, while the supply of toner to a developer and the dynamic range of a latent image are controlled in combination in response to the output of the photosensor.

15 Claims, 9 Drawing Sheets

TESTING IMAGE DENSITY TO CONTROL TONER CONCENTRATION AND DYNAMIC RANGE IN A DIGITAL COPIER

This application is a continuation of application Ser. No. 07/827,868, filed on Jan. 30, 1992, now abandoned, which is a continuation of application Ser. No. 07/545,508, filed on Jun. 29, 1990, now abandoned.

BACKGROUND OF THE INVENTION

Field of the Invention

The present invention relates to a developing system for an electrophotographic image forming apparatus and, more particularly, to a developing system for use with a digital color copier and of the type using a developer made up of a toner and a carrier, i.e. a two-component developer.

A prerequisite with a digital color copier adopting the above-described type of developing system is that the toner concentration of the two-component developer be adequately regulated to enhance the reproducibility of tones, especially halftone, of images. To meet this requirement, various toner concentration control methods have heretofore been proposed. The conventional methods may generally be classified into two types, as follows:

Type A: sensing toner concentration or a substitute characteristic and controlling it to a predetermined one; and Type B: sensing the developing ability of a developer or a substitute characteristic and controlling toner concentration such that the developing ability remains constant.

The type A method consists in, for example, detecting changes in the vlume density of a developer (Japanese Patent Laid-Open Publication No. 5487/1972), detecting changes in the volume density of a developer in terms of changes in magnetic permeability or reactance (Japanese Patent Laid-Open Publication No. 5138/1972), detecting changes in the volume of a developer (Japanese Patent Laid-Open Publication No. 19459/1975), detecting changes in the volume of a developer in terms of changes in torque (Japanese Patent Laid-Open Publication No. 6589/1972), detecting changes in the tone of a developer (Japanese Patent Laid-Open Publication No. 69527/1973), detecting changes in the electric resistance of a developer (Japanese Patent Laid-Open Publication No. 38157/1973), or detecting a voltage induced by the counter charge (on a carrier) of a developed toner (Japanese Patent Laid-Open Publication Nos. 57638/1973 and 42739/1973). The type B methods include one in which a charge pattern immune to a photoconductive body is formed and then developed to optically sense the density of the resulting toner image.

Such prior art methods, whether it be of type A or type B, cannot satisfactorily reproduce halftone images. Specifically, toner concentration generally varies with the ambient conditions and due to aging. Hence, the type A method which maintains toner concentration constant causes the developing characteristic of the developer to change due to changes in ambient conditions and aging. This type of method, therefore, is not directly applicable to a color copier which attaches importance to the reproducibility of halftones. In the light of this, there have also been proposed a control method which controls the quantity of exposing light by sensing ambient conditions as well as other factors (Japanese Patent Laid-Open Publication No. 177153/1988), and a control method which develops a plurality of potential patterns, optically senses the densities of the resulting toner images, and selects adequate one of exposing potential data which were measured in various environments (Japanese Patent Laid-Open Publication No. 296060/1988). These methods, however, cannot cope with changes in the charging characteristic of a developer due to aging. Although they will be capable of coping with such changes if provided with data covering both the aging and the ambient conditions, preparing such an amount of data is not practical. Moreover, optimizing the developing characteristic by any of the above-mentioned methods is almost impracticable because toner concentration is susceptible to operation modes as well as to aging and ambient conditions.

The type A method is not satisfactory not only from the standpoint of the above-discussed optimization of developing characteristic but also from the standpoint of adequate toner concentration. Specifically, the limit of toner concentration at which the contamination of background and the scattering of toner sharply increase is also susceptible to changes in ambient conditions and aging. It follows that controlling the toner concentration to a predetermined one as with the type A method is apt to bring about the contamination of background and the scattering of toner due to changes in ambient conditions and aging. As a result, even when the developer is still usable, it is often determined that it should be replaced with fresh one. Concerning the type B method which so controls the toner concentration as to maintain the developing ability constant, all the changes in the developer ascribable to the environment and aging are fed back to the toner concentration, broadening the range over which the toner concentration is varied. Consequently, the developing ability of the developer is increased in a high humidity environment or in an aged condition. In this condition, should the toner concentration be reduced to control the developing ability to a usual one, the resulting toner concentration would be excessively low to in turn reduce the maximum amount of development, i.e. saturation image density. For this reason, the halftone reproducibility achievable with the type B method is as poor as with the type A method.

SUMMARY OF THE INVENTION

It is therefore an object of the present invention to provide a developing system of the type using a two-component developer and capable of reproducing image densities and halftone images stably at all times with no regard to varying ambient conditions and aging.

It is another object of the present invention to provide a generally improved developing system of the type using a two-component developer.

In an image forming system comprising a charger for uniformly charging the surface of a photoconductive element to a predetermined potential, and an exposing unit for exposing the surface of the photoconductive element to a light image to electrostatically form a latent image thereon, a developing system for developing the latent image to produce a toner image of the present invention comprises a sensor pattern forming device for forming at least two toner image patterns each having a particular toner density on the photoconductive element, a photosensor for sensing the amounts of toner deposited on the individual toner image patterns to generate an output signal, and a controller responsive to the output signal of the photosensor for variably controlling the amount of toner to be supplied to a developer and the dynamic range of a latent image.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
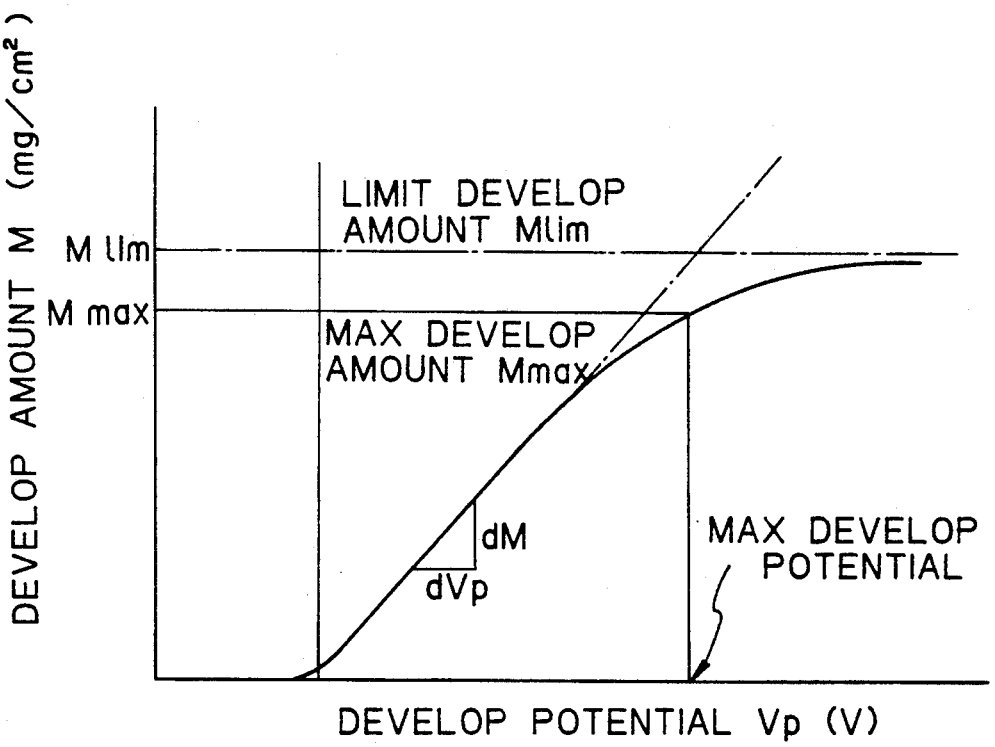
FIG. 1 is a graph representative of a developing characteristic.
Figure 2:
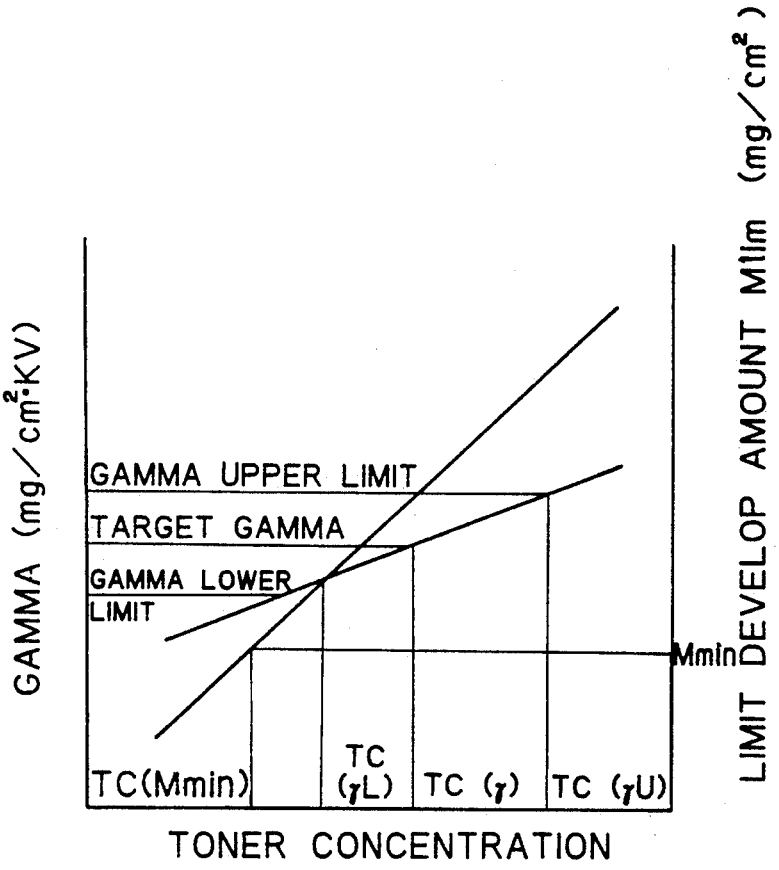
FIG. 2 is a graph indicating the dependency of a developing characteristic on toner concentration.

To better understand the present invention, a developing system of the type using a two-component developer will be described generically. FIG. 1 shows a developing characteristic particular to this type of developing system. As shown, the developing characteristic has two difference ranges, i.e., a linear range in which the developing amount M linearly increases with the increase in the developing potential Vp, and a saturation range in which the former gradually approaches the limit developing amount Mlim away from the line in the linear range with the increase in the latter. The gradient dM/dVp of the linear range is generally referred to as development gamma. As shown in FIG. 2, both the gamma and the limit developing amount Mlim are dependent on the concentration of toner in a developer, i.e., the former increases with the increase in the latter. Regarding the reproducibility of a halftone image, a prerequisite with this type of developing system is that limit developing amount Mlim be sufficiently greater than the developing amount Mmax corresponding to the maximum developing potential of the system. Specifically, the system has to be used in the linear range in order to enhance the reproducibility of tones. The lower limit of toner concentration, therefore, should be limited by some means or method.

Figure 3:
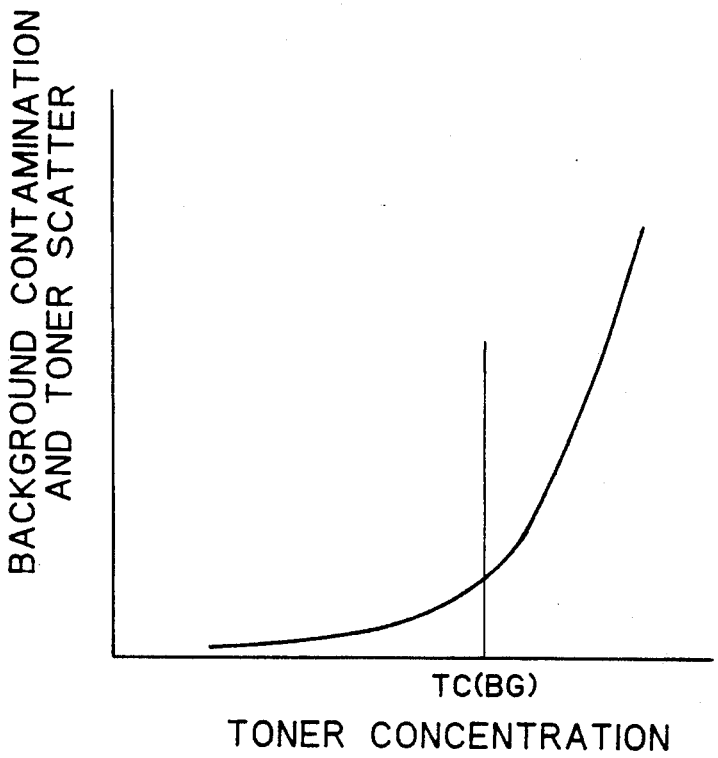
FIG. 3 is a graph indicating the dependency of background contamination and other occurrences on toner concentration.

On the other hand, as FIG. 3 indicates, toner concentrations higher than a certain value TC(BG) cause toner particles to deposit on and contaminate the background and to scatter around off the developer to the outside of a developing unit, for the following reason. Specifically, carrier and toner particles constituting a two-component developer rub against each other and are charged thereby. Hence, when the amount of toner is excessive relative to the limited effective charging area of carrier, the toner cannot be sufficiently charged and is are, therefore, separated from the carrier to cause the above-mentioned undesirable occurrence. It follows that the toner concentration has to be provided with an upper limit by some means or method.

Figure 4:
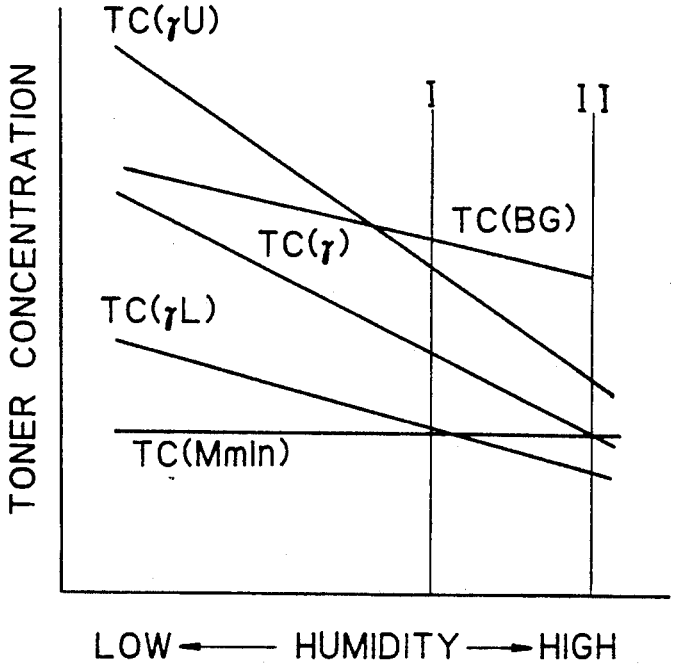
FIG. 4 is a graph showing the variation of toner concentration due to the variation of an ambient condition.
Figure 5:
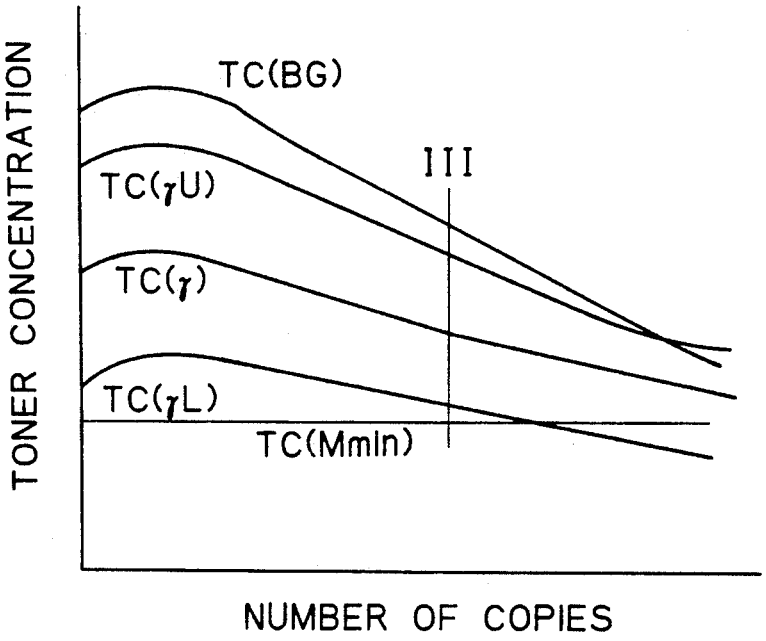
FIG. 5 is a graph representative of the variation of toner concentration due to aging.

Generally, the developing characteristic of and the background contamination by a two-component type developer stated above changes every moment depending on ambient conditions in which the machine is operated or left non-operated, the duration of non-operation, the number of times copies are produced, etc. Presumably, this is ascribable to the amount of adsorption of water molecules by the surfaces of toner and carrier which varies with temperature and humidity, the amount of deposition of impurities on the carrier surface which varies with the duration of operation, and the variation of the charging and discharging amounts of toner (and carrier). FIGS. 4 and 5 show how the toner concentration which determines the characteristic points of developing characteristic varies with the ambient conditions and due to aging, by using specific values determined by experiments. FIG. 4 shows the toner concentration in relation to the variation in humidity which is one typical ambient condition. The characteristic shown in Fig. 4 was measured with the number of copies produced being fixed to a particular number represented by III in FIG. 5. FIG. 5 shows a characteristic measured by taking account of aging, i.e., with the number of copies produced being increased. The curves of FIG. 5 were attained with the ambient conditions being maintained constant, i.e., with the humidity being fixed at I shown in FIG. 4. Actually, these variations are combined with each other as well as with other variations such as one ascribable to the operation modes including the area ratio of a document, how many copies should be produced with a single copy, how many copies should be produced by one operation, and how long the machine has been left non-operated as counted from the last copying operation.

In FIGS. 2, 4 and 5, a curve TC(Mmin) indicates toner concentrations which prevents the developing amount Mmax associated with the maximum potential of the developing system from becoming less than the minimum necessary developing amount of the system. A curve TC($\gamma$) indicates toner concentrations which allow the gamma to coincide with the target value. A curve TC($\gamma$U) is representative of the upper limit of gamma required with the system; higher toner concentrations would thicken characters and/or result in short resolution. Further, a curve TC($\gamma$L) is the lower limit of gamma which is required with the system; lower toner concentrations would lower the image density beyond an allowable range. It is to be noted that the curve TC($\gamma$L) was estimated by using the linear portion of the developing characteristic and, in practice, the image density will be further lowered due to the previously mentioned saturation.

In any case, in the developing system using a two-component type developer, the toner concentration has a critical effect on the developing characteristic and, therefore, has to be adequately controlled. While the previously stated control methods A and B have been proposed in the past, they are not fully satisfactory for the reasons discussed earlier.

Figure 6:
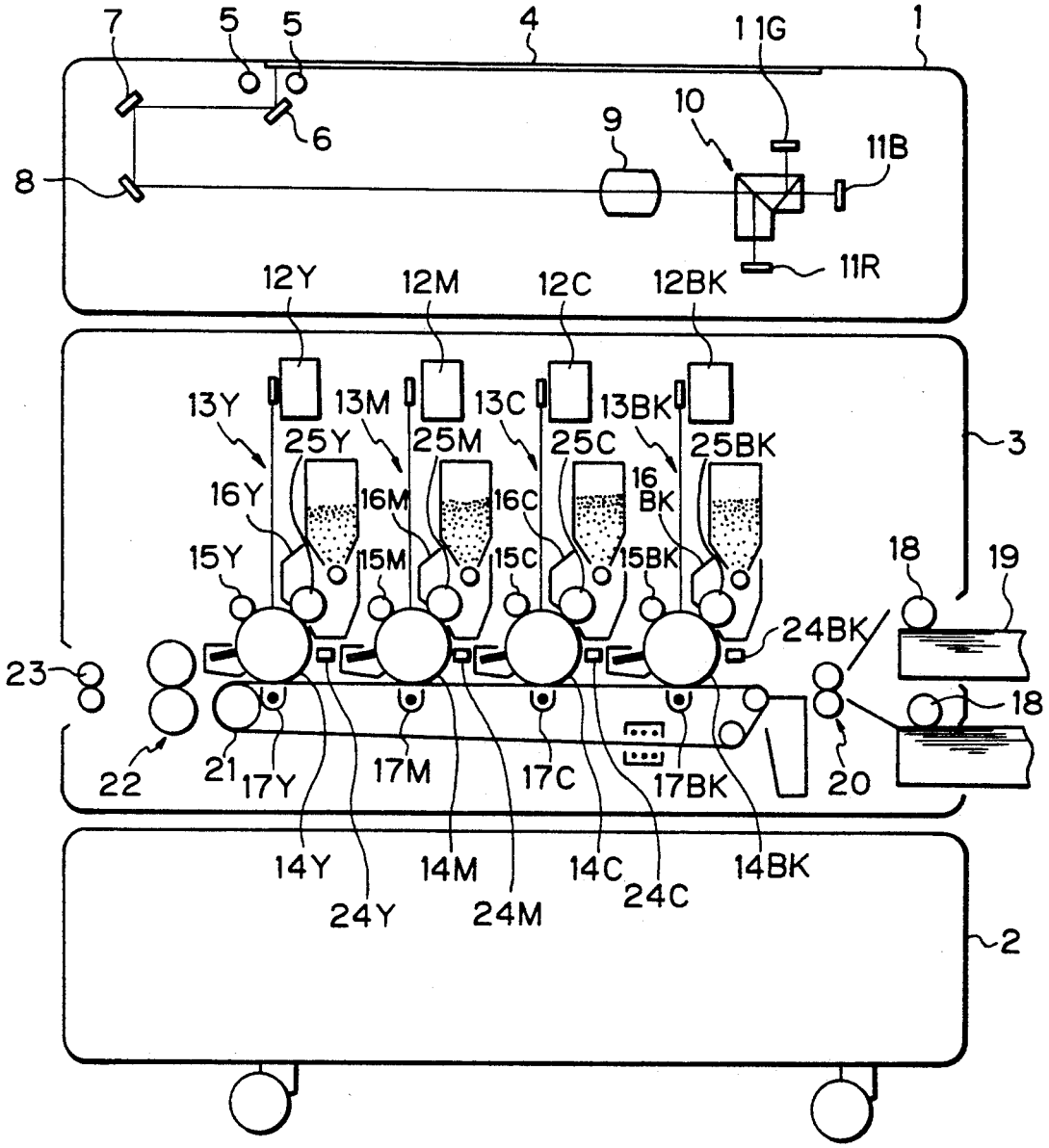
FIG. 6 is a section showing a color copier to which a preferred embodiment of the developing system in accordance with the present invention is applicable.

Referring to FIGS. 6 to 9, a preferred embodiment of the developing system in accordance with the present invention will be described. FIG. 6 schematically shows a digital color image forming apparatus (color copier) to which the present invention is applicable. As shown, the apparatus is generally made up of a scanner section 1 for scanning a document, an image processing section 2 for electrically processing a digital image signal outputted by the scanning section 1, and a printer section 3 for printing out an image on the basis of color-by-color image recording information outputted by the image processing section 2. The scanner section 1 has a fluorescent lamp or similar lamp 5 for illuminating a document laid on a glass platen 4. A reflection from the document is incident to a focusing lens 9 via mirrors 6, 7 and 8. The lens 9 focuses the incident light onto a dichroic prism 10 with the result that the light is spectrally separated into three components each having a different wavelength, e.g. red (R), green (G) and blue (B) components. These color components are incident to individual light-sensitive devices such as CCD (Charge Coupled Device) arrays 11R, 11G, and 11B and thereby transformed into digital signals. The image processing section 2 effects necessary processing with the outputs of the CCD arrays 11R, 11G and 11B to convert them into recording information of different colors, e.g. black (BK), yellow (Y), magenta (M) and cyan (C) signals.

While the apparatus of FIG. 6 is shown as forming a color image in four colors BK, Y, M and C, it may form a color image in only three colors by having one of four recording devices, which will be described, omitted.

The individual color signals from the image processing section 2 are fed to associated laser writing units 12BK, 12C, 12M and 12R which are incorporated in the printer section 3. In the specific arrangement of FIG. 6, four recording devices 13BK, 13C, 13M and 13Y are arranged side by side in the printer section 3. Since all the recording devices 13BK to 13Y have identical structural parts and elements, the following description will concentrate on the device 13C adapted for cyan C by way of example. The structural parts and elements of the other recording devices are identical with those of the device 13C and are designated by the same reference numerals with suffixes BK, M and Y.

The recording device 13C has a photoconductive element 14C in the form of a drum, for example, in addition to the laser writing unit 12C. Sequentially arranged around the drum 14C are a main charger 15C, an exposing position where a laser beam issuing from the laser writing unit 12C will scan the drum 14C, a developing unit 16C, a transfer charger 17C, and so forth. While the main charger 15C unformly charges the surface of the drum 14C, the laser writing device 12C scans the charged drum surface with a laser beam with the result that a latent image representing a cyan component is electrostatically formed on the drum 14C. Then, the developing unit 16C develops the latent image to produce a toner image. A paper feeding section 19 is implemented as two paper cassettes, for example. A paper sheet fed from either one of the paper cassettes by an associated feed roller 18 is driven to a register roller pair 20 and, at a predetermined timing, driven way from the register roller pair 20 to a transfer belt 21. The transfer belt 21 transports the paper sheet sequentially to the drums 14BK, 14C, 14M and 14Y each carrying a toner image of a particular color thereon. The transfer chargers 17BK to 17Y associated with the drums 13BK to 14Y, respectively, transfer such toner images sequentially to the paper sheet. The paper sheet carrying the resultant color image thereon is driven out of the apparatus by a discharge roller pair 23 after having the image fixed thereon. In this instance, the paper sheet is electrostatically retained by the transfer belt 21 and, therefore, transported with accuracy. Reflection type photosensors or P sensors 24BK, 24C, 24M and 24Y are associated with the drums 14BK, 14C, 14M and 14Y, respectively, and each optically senses the amount of toner deposited on a toner image pattern which will be described. The P sensors 24BK to 24Y are operable in the same manner as each other with their associated drums 14BK to 14Y and, in the following description, they will be represented by the reference numeral 24 without suffix.

In the illustrative embodiment, sensor pattern forming means forms toner density patterns to be sensed by the P sensor 24 and is also implemented with the charger 15, laser writing unit 12, and developing unit 16. Specifically, the toner image patterns each has a particular image density. Such toner image patterns may be formed by any of some different implementations, as follows. For example, an arrangement may be made such that the quantity of exposing light issuing from the laser writing unit 12 is changed in two steps to form latent image patterns having two different potentials, while the potential of a developing sleeve 25, i.e., a developing bias is maintained constant. Conversely, the quantity of exposing light from the laser writing unit 12 may be maintained constant to form latent images of the same potential (latent image patterns of the same kind), in which case the developing bias of the sleeve 25 will be changed in two steps. Another alternative implementation is to form two latent image patterns having different potentials and developing them by different developing biases. The toner imge patterns are not limited to solid images and may even be dot or line patterns representing desired tones.

Figure 7:
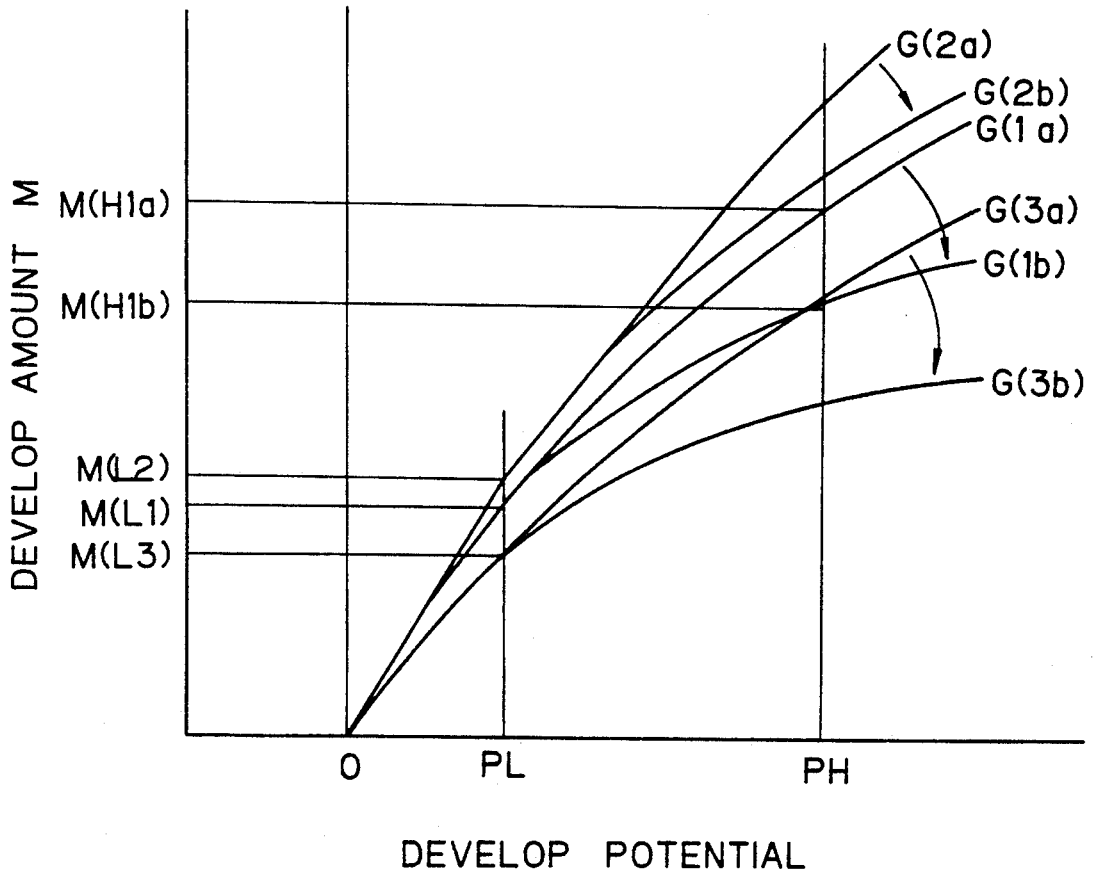
FIG. 7 is a graph showing a developing characteristic in terms of developing amounts and developing potentials of two different patterns.

Assume that the developing potentials of the two latent image patterns ascribable to the differences between the surface potentials and the developing bias, which is the same in the illustrative embodiment, are PL and PH(PL<PH), and that, among tones 0 to 7, tones 3 and 7 are assigned to PL and PH, respectively. Further, assume that when the dynamic range I of a latent image (difference between the maximum and minimum values of the surface potential of a drum formed by a latent image) has a certain value, a developing characteristic G(1*a*) shown in FIG. 7 is the optimal characteristic. Then, the developing amounts of the patterns whose developing potentials are PL and PH are M(L1) and (H1*a*), respectively. When the toner concentration is increased in the above environment, i.e., at the same time, the developing characteristic is shifted from G(1*a*) to G(2*a*), FIG. 7, causing the developing amounts associated with the developing potentials PL and PH to change to M(L2) and M(H2*a*), respectively. Conversely, a decrease in the toner concentration shifts the developing characteristic from G(1*a*) to G(3*a*), FIG. 7, while the developing amounts associated with PL and PH change to M(L3) and M(H3*a*), respectively. With the developing characteristic of FIG. 7, therefore, it is possible to control the toner concentration such that the actual developing characteristic approaches the target characteristic G(1*a*), if the P sensor 24 senses either one of the developing amounts associated with PL and PH. This is the same as the system using a P sensor. In the illustrative embodiment, the above control is effected by using the pattern image having the lower developing potential PL.

The above description has concentrated on the same environment and the same time point. How the developing characteristic changes with the environment will be described hereinafter. Assume that the ambient humidity is increased while the developing amount of the pattern associated with the developing potential PL is sensed by the P sensor 24 and controlled to a target value. As shown in FIG. 4, as the ambient humidity increases, toner concentration for maintaining the adequate gamma decreases with the result that, as FIG. 2 indicates, the saturation developing amount decreases. Hence, the developing characteristic varies as represented by a curve G(1*b*), FIG. 7, whereby the developing amount M(1*b*) associated with the developing potential PH is made smaller than the amount M(H1*a*) associated with usual humidity. It follows that the dynamic range I is adjustable by detecting the difference between M(1*b*) and M(H1*a*).

Figures 8A, 8B:
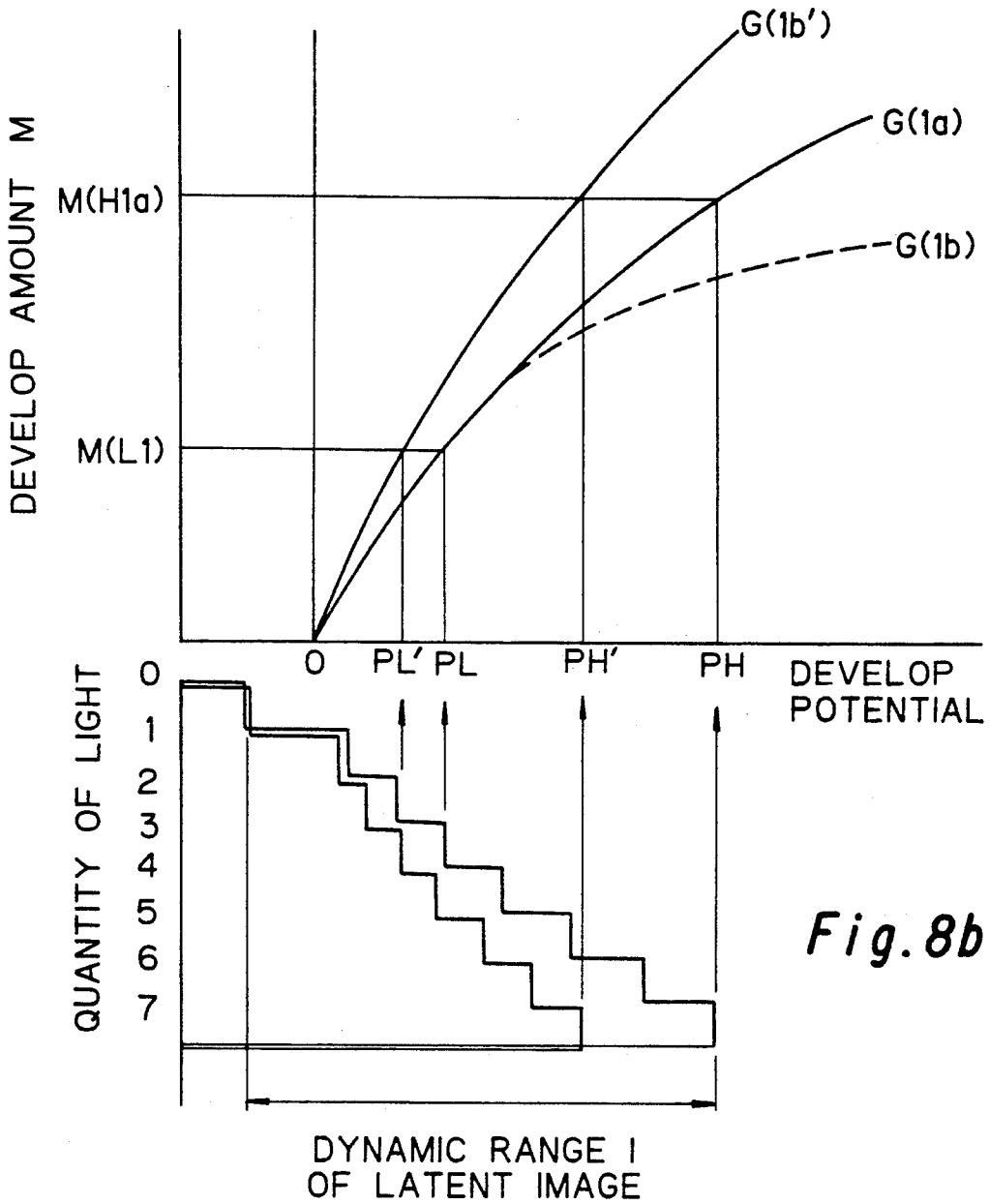
FIG. 8 is a graph indicating how the developing characteristic changes in association with the adjustment of the dynamic range of a latent image.

To facilitate an understanding of the adjustment of the dynamic range I, let it be assumed that the maximum quantity of light of a light image and the developing potential PH are equal to each other, although not necessarily equal in practice. Referring again to FIG. 7, on the change of the developing characteristic from G(1*a*) to G(1*b*), the tone reproducibility is degraded and the maximum amount of toner deposition (=m(1*b*) is reduced. In the light of this, the dynamic range I of the latent image is reduced with the ratio of the developing potentials PL and PH being held constant. Then, since the toner concentration is so controlled as to maintain M(L1) constant, it sequentially increases with the decrease in developing potential PL→PL′ with the result that the curve representative of the developing characteristic rises away from G(1*b*). Such adjustment is continued until the developing amount M(H1*b*) coincides with the target value M(H1*a*), i.e., until the developing characteristic G(1*b*′) holds, on the basis of the output of the P sensor 24 associated with the developing potentials PH to PH′. This is successful in maintaining the developing amount associated with the image signal constant. Therefore, the color copier shown in FIG. 6 is capable of reproducing halftones in a desirable manner. It will be seen that the present invention is characterized in that when the target developing characteristic G(1*a*), FIG. 8, is changed to G(1*b*) due to the highly humid environment, control is effected to shift the characteristic G(1*a*) to the characteristic G(1*b*′).

When the humidity is low, a procedure opposite to the above-stated procedure will be executed. The control described above in relation to humidity is also true with aging. While the illustrative embodiment changes the dynamic range by changing the quantity of light issuing from the exposing means 12, the quantity of light may be replaced with the charging potential of the main charger 15 or may be changed along with the latter.

Figure 9:
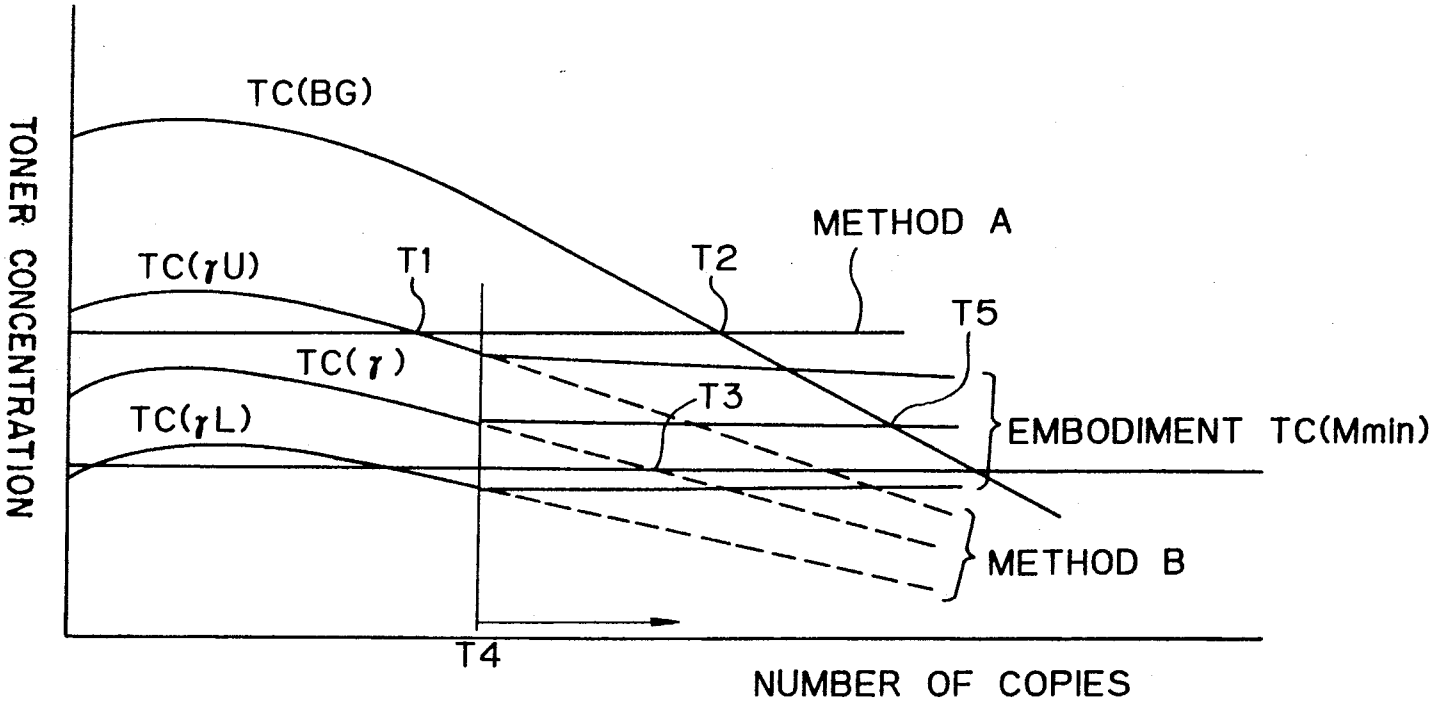
FIG. 9 is a graph comparing the illustrative embodiment and the prior art with respect to variation in toner concentration.

FIG. 9 compares the illustrative embodiment and the prior art methods A and B with respect to the variation of toner concentration. While the curves of FIG. 9, like those of FIG. 5, pertain to aging as defined by the number of copies produced, they are representative of changes in a high humidity environment II, FIG. 4, as distinguished from the usual humidity environment of FIG. 5. As shown, the method A which controls the toner concentration to a predetermined value fails to achieve high image quality and wastes the developer unless the developer is replaced at a time $T_1$ at which the toner concentration coincides with the concentration TC(γU). In this connection, some black-and-white printers available today allow the developer to be used until a time $T_2$ at which time the toner concentration coincides with the toner density TC(BG). The method B which controls the developing ability to a predetermined one determines that the life of the developer has expired at a time $T_3$ at which time the toner concentration TC(γ) coincides with TC(Mmin), requiring the developer to be replaced, as indicated by dotted lines in the figure. In contrast, with the illustrative embodiment which controls the toner concentration TC(γ) constant while preventing it from decreasing beyond the initial value, it is possible to use the developer until the toner concentration TC(BG) reaches the target concentration TC(γ) at a time $T_5$. Concerning the illustrative embodiment, FIG. 9 indicates a case wherein the dynamic range is sequentially reduced from the time $T_4$. The curves of FIG. 9 show that the illustrative embodiment is capable of insuring high image quality over a long period of time and extends the life of the developer, compared to the prior art methods.

In summary, in accordance with the present invention, at least two toner image patterns each having a particular toner density are formed on a photoconductive element. The amounts of toner deposited on the individual patterns are sensed by photosensors, while the supply of toner to a developer and the dynamic range of a latent image are controlled in combination in response to the outputs of the photosensors. Hence, stable image density and halftone reproducibility are insured at all times against changes in ambient conditions and aging. Specifically, the toner is prevented from contaminating background, scattering around, or decreasing in concentration excessively, whereby effective use of the developer is promoted over a long period of time. Such at least two different toner image patterns are easy to implement by modifying ordinary exposing or developing means, e.g., by developing the same kind of latent image patterns by use of different developing biases or by developing different kinds of latent image patterns by use of the same developing bias. The dynamic range of a latent image is also readily controllable only if ordinary charging or exposing means is modified to change the charging potential or the quantity of exposing light.

Various modifications will become possible for those skilled in the art after receiving the teachings of the present disclosure without departing from the scope thereof.

What is claimed is:

1. In an image forming system comprising charging means for uniformly charging a surface of a photoconductive element to a predetermined potential, and exposing means for exposing said surface of said photoconductive element to a light image to electrostatically form a latent image on said surface, a developing system for developing said latent image to produce a toner image, comprising:

sensor pattern forming means for forming two toner image patterns on the photoconductive element, each of said two toner image patterns having a different particular toner density on the photoconductive element;

a photosensor for sensing toner densities of toner deposited on said two toner image patterns; and control means for determining a difference between the sensed toner densities of toner deposited on the two toner image patterns, for variably controlling an amount of toner to be supplied to a developer and for variably controlling a dynamic range of a latent image such that the toner density difference between said two toner image patterns is maintained at a predetermined difference value, wherein said dynamic range represents a difference between maximum and minimum values of a surface potential of said photoconductive element on which said latent images are formed.

2. A system as claimed in claim 1, wherein said control means controls the dynamic range such that when the toner density difference is lower than said predetermined value, the dynamic range is reduced to increase the toner density.

3. A system as claimed in claim 1, wherein said control means changes the dynamic range of a latent image by changing a charging potential of the charging means.

4. A system as claimed in claim 1, wherein said control means changes the dynamic range of a latent image by changing a quantity of exposing light of the exposing means.

5. A system as claimed in claim 1, wherein said sensor pattern forming means develops each of a same kind of latent image patterns by a difference developing bias.

6. A system as claimed in claim 1, wherein said sensor pattern forming means develops each of different kinds of latent image patterns by a same developing bias.

7. A system as claimed in claim 1, wherein the toner image patterns comprise two kinds of line patterns produced by controlling an amount of exposure, and the dynamic range is variably controlled such that the difference in density between the two kinds of line patterns remains constant.

8. A system as claimed in claim 7, wherein the two kinds of line patterns are a line pattern of maximum density and a line pattern of medium density.

9. A system as claimed in claim 7, wherein the toner image patterns further comprise a solid pattern of medium density, and the toner concentration (toner supplement) is controlled on the basis of the solid pattern.

10. A developing method for an image forming system comprising the steps of:

(a) uniformly charging a surface of a photoconductive element to a predetermined potential;

(b) exposing the surface of the photoconductive element to a light image to electrostatically form a latent image on the surface;

(c) forming two toner image patterns on the surface of the photoconductive element, each of said two toner image patterns having a different particular toner density;

(d) sensing toner densities of toner deposited on the two toner image patterns;

(e) determining a difference between the sensed toner densities of toner deposited on the two toner image patterns and controlling an amount of toner to be supplied to a developer such that the sensed amount of toner coincides with a predetermined amount; and (f) variably controlling a dynamic range of a latent image such that the toner density difference between the two toner image patterns is maintained at a predetermined difference value, wherein said dynamic range represents a difference between maximum and minimum values of a surface potential of said photoconductive element on which said latent images are formed.

11. A developing method as claimed in claim 10, wherein step (f) comprises (g) reducing the dynamic range to increase the toner density when the toner density difference is lower than said predetermined value.

12. A developing method as claimed in claim 10, wherein step (f) comprises (g) changing the dynamic range of a latent image by changing a charging potential.

13. A developing method as claimed in claim 10, wherein step (f) comprises (g) changing the dynamic range of a latent image by changing a quantity of exposing light.

14. A developing method as claimed in claim 10, wherein step (c) comprising (g) developing each of a same kind of latent image patterns by a different developing bias.

15. A developing method as claimed in claim 10, wherein step (c) comprises (g) developing each of different kinds of latent image patterns by a same developing bias.

* * * * *